US011305299B2

(12) United States Patent
Otoguro

(10) Patent No.: US 11,305,299 B2
(45) Date of Patent: Apr. 19, 2022

(54) MICRO-BUBBLE GENERATOR AND SHOWER HEAD

(71) Applicant: TOSHIN INC., Nagoya (JP)

(72) Inventor: Koichi Otoguro, Nagoya (JP)

(73) Assignee: Toshin Inc., Aichi (JP)

( * ) Notice: Subject to any disclaimer, the term of this patent is extended or adjusted under 35 U.S.C. 154(b) by 428 days.

(21) Appl. No.: 16/498,536

(22) PCT Filed: Apr. 5, 2017

(86) PCT No.: PCT/JP2017/014183
§ 371 (c)(1),
(2) Date: Sep. 27, 2019

(87) PCT Pub. No.: WO2018/185866
PCT Pub. Date: Oct. 11, 2018

(65) Prior Publication Data
US 2020/0030825 A1 Jan. 30, 2020

(51) Int. Cl.
*B05B 1/18* (2006.01)
*B01F 23/231* (2022.01)
(Continued)

(52) U.S. Cl.
CPC ..... *B05B 1/18* (2013.01); *B01F 23/231* (2022.01); *B01F 23/2373* (2022.01); *B01F 23/237611* (2022.01)

(58) Field of Classification Search
CPC ..... B05B 1/18; B05B 1/185; B05B 7/005; B05B 7/0425; B01F 23/231;
(Continued)

(56) References Cited

U.S. PATENT DOCUMENTS 3,450,350 A * 6/1969 Gullaksen ..... E03C 1/084 239/428.5
4,562,960 A * 1/1986 Marty ..... G05D 7/012 239/72
(Continued)

FOREIGN PATENT DOCUMENTS

CN 1578867 A 2/2005
CN 101795757 A 8/2010
(Continued)

OTHER PUBLICATIONS

Chinese Office Action issued in the corresponding Chinese Application No. 201780088716.3 dated May 12, 2021 and English translation.
(Continued)

*Primary Examiner* — Darren W Gorman
(74) *Attorney, Agent, or Firm* — Browdy and Neimark, PLLC

(57) ABSTRACT

One object is to generate, without the need for a motive power source and a high level of machining accuracy, micro-bubbles containing a large amount of fine air bubbles. Another object is to provide a micro-bubble generator that switches between micro-bubble water, which contains micro-bubbles, and foamed water containing a large amount of air and having a tender texture. The micro-bubble generator includes: a water passage that includes a smaller diameter portion and a larger diameter portion disposed on the downstream side of the smaller diameter portion; an air inlet disposed in the larger diameter portion and an elastic body disposed in the air inlet and configured to isolate the water passage from external air. The elastic body is compressible by negative pressure generated in the water passage, causing the external air to be sucked into the water
(Continued)

passage through the air inlet and over the compressed elastic body.

9 Claims, 9 Drawing Sheets

(51) Int. Cl.
*B01F 23/2373* (2022.01)
*B01F 23/237* (2022.01)

(58) Field of Classification Search
CPC ..... B01F 23/2373; B01F 23/237611; E03C 1/08; E03C 1/084; G05D 7/012
See application file for complete search history.

(56) References Cited

U.S. PATENT DOCUMENTS

| | | | | |
|---|---|---|---|---|
| 9,639,095 | B2 * | 5/2017 | Schurle | E03C 1/04 |
| 2005/0001064 | A1 | 1/2005 | Taketomi et al. | |
| 2011/0240767 | A1 | 10/2011 | Kitaura et al. | |
| 2017/0197223 | A1 | 7/2017 | Otoguro et al. | |
| 2018/0080204 | A1 * | 3/2018 | Norling | E03C 1/084 |

FOREIGN PATENT DOCUMENTS

| | | | |
|---|---|---|---|
| CN | 102206946 | A | 10/2011 |
| EP | 1443151 | A1 | 8/2004 |
| EP | 2374946 | A2 | 10/2011 |
| JP | H10-94722 | A | 4/1998 |
| JP | 2005-290686 | A | 10/2005 |
| JP | 4002439 | B | 10/2007 |
| JP | 2008-12512 | A | 1/2008 |
| JP | 3190442 | U2 | 5/2014 |
| JP | 2015-71137 | A | 4/2015 |
| WO | 2017/029835 | A1 | 2/2017 |

OTHER PUBLICATIONS

English translation of International Search Report dated Jul. 20, 2017, issued in corresponding PCT International Application No. PCT/JP2017/014183.

English translation of International Preliminary Report on Patentability issued in corresponding PCT International Application No. PCT/JP2017/014183.

English translation of Notice of Reasons for Refusal dated May 31, 2019, issued in corresponding Japanese Application No. JP2019-510549.

* cited by examiner

[Fig. 1]
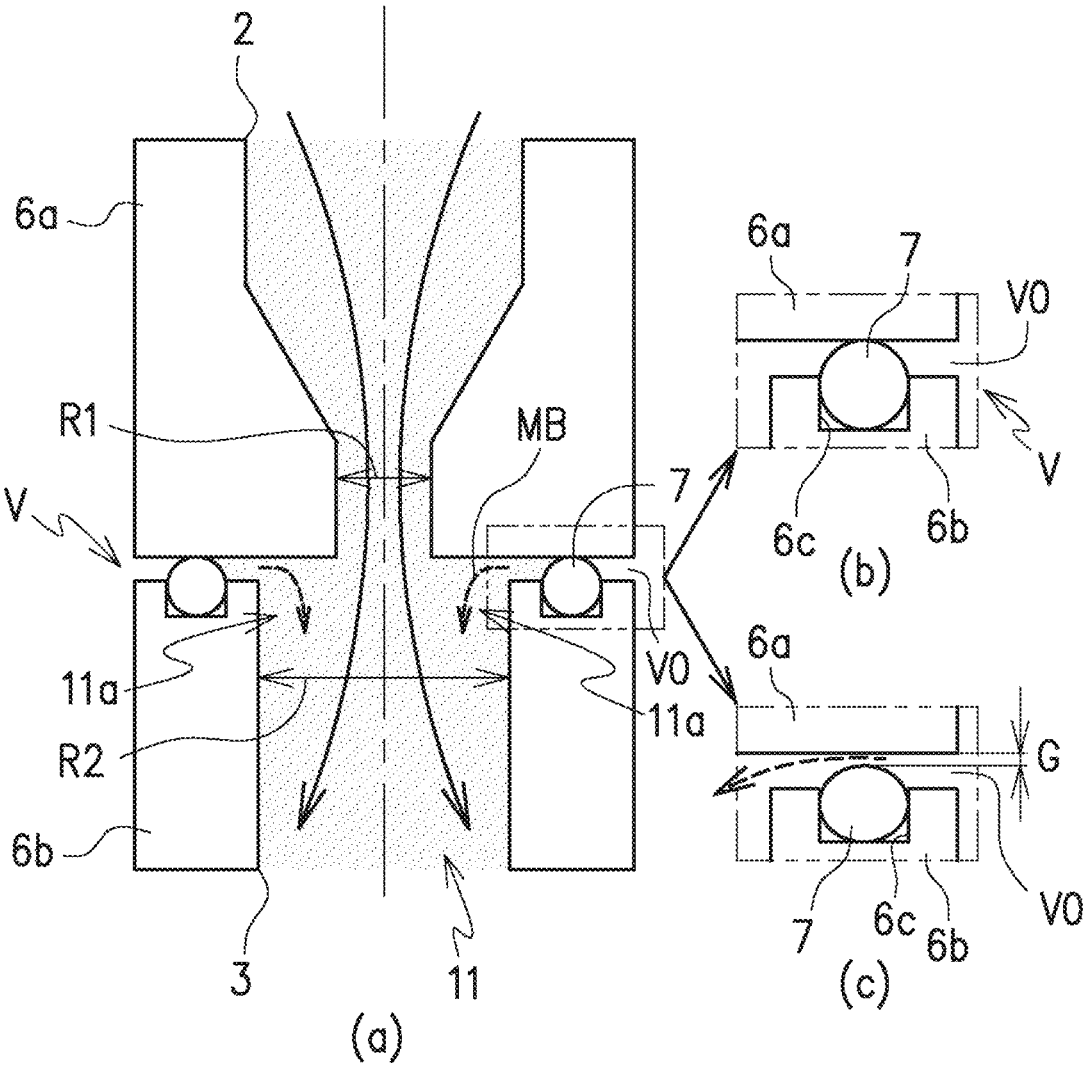

[Fig. 2]
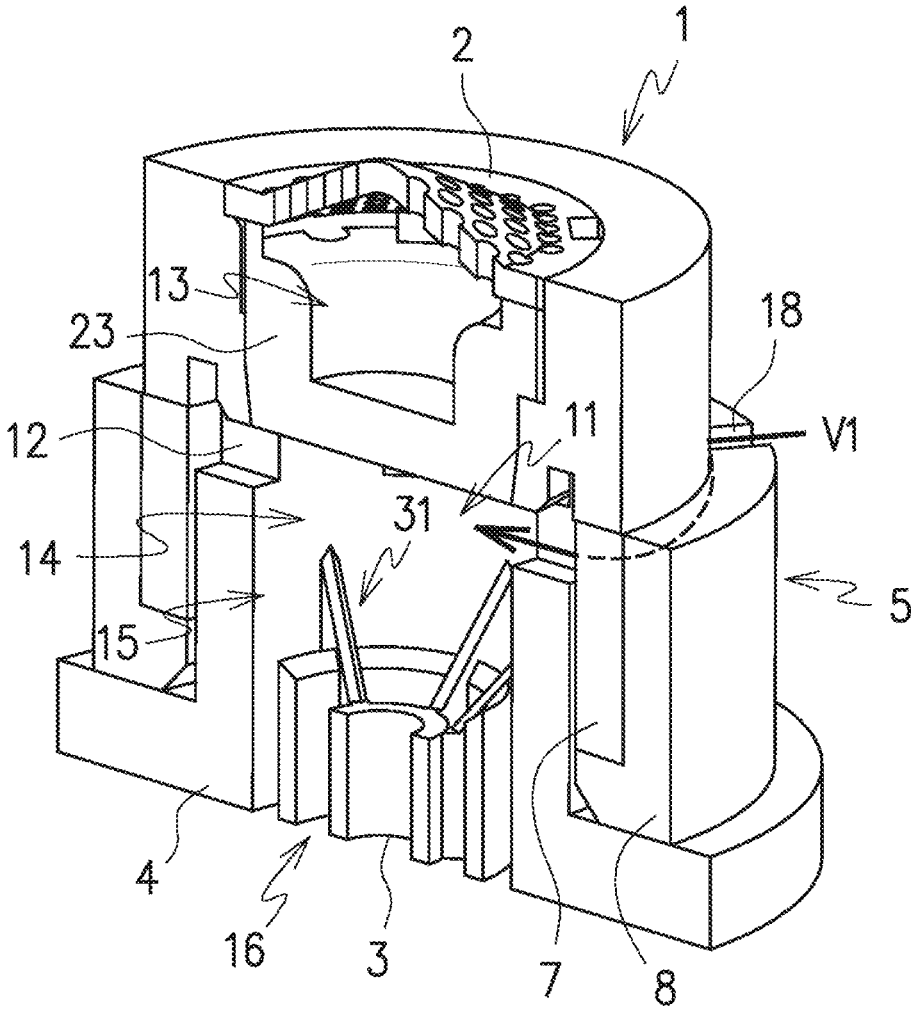

[Fig. 3]
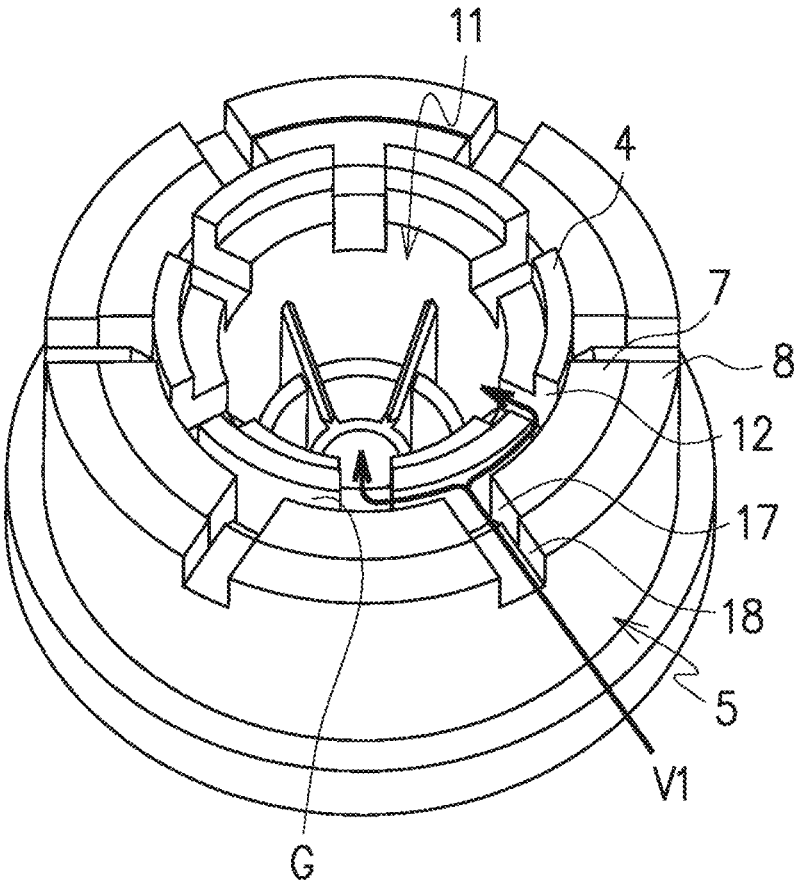

[Fig. 4]
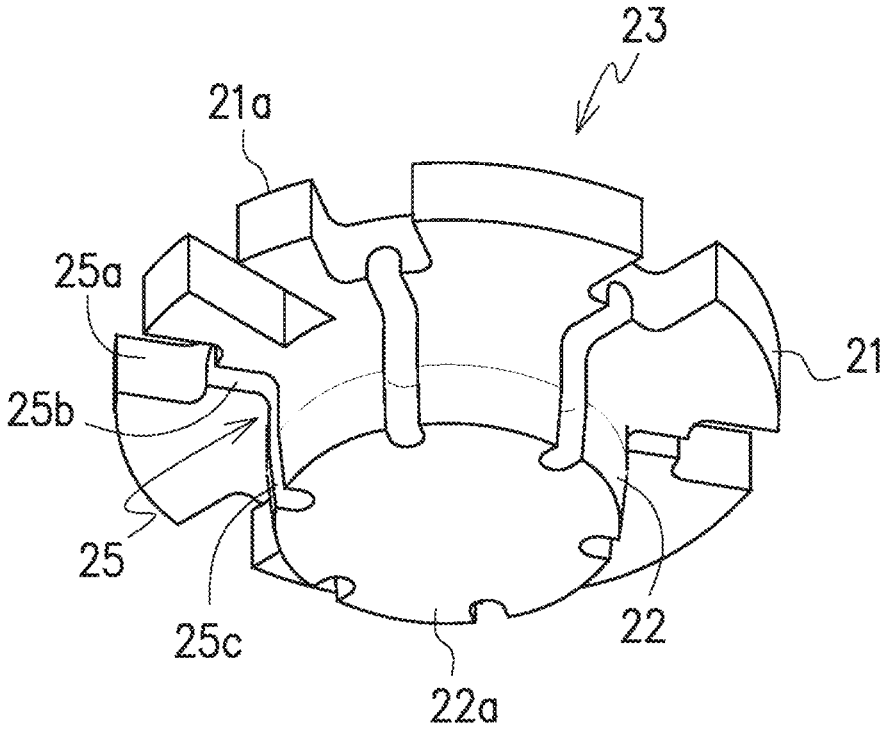

[Fig. 5]
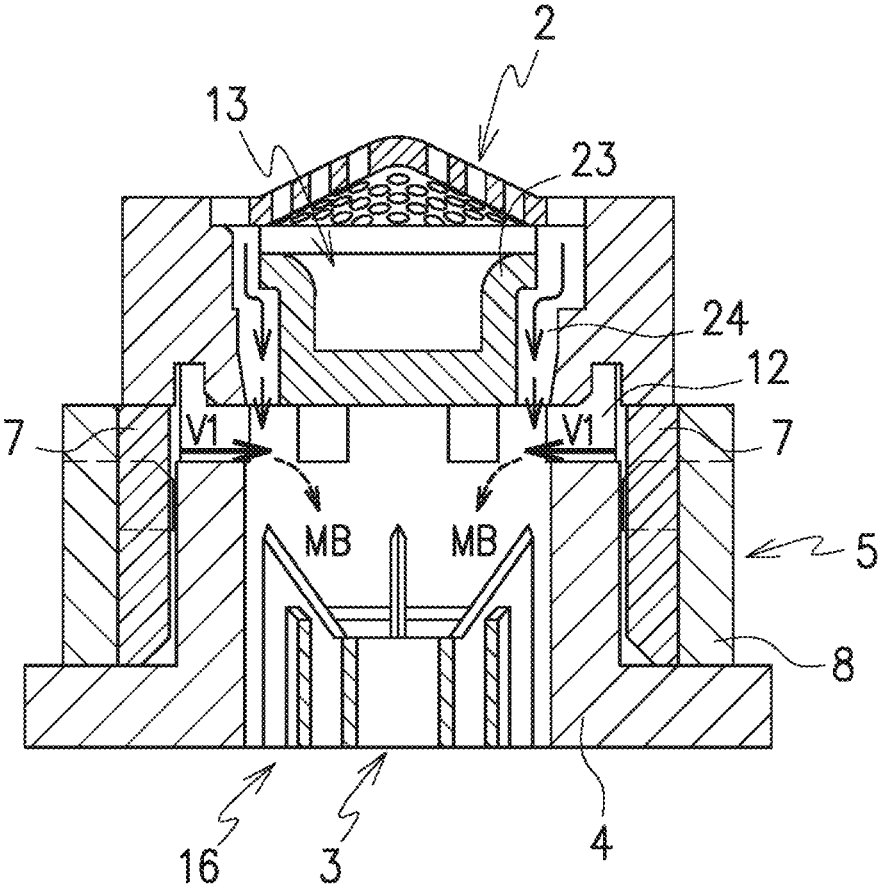

[Fig. 6]
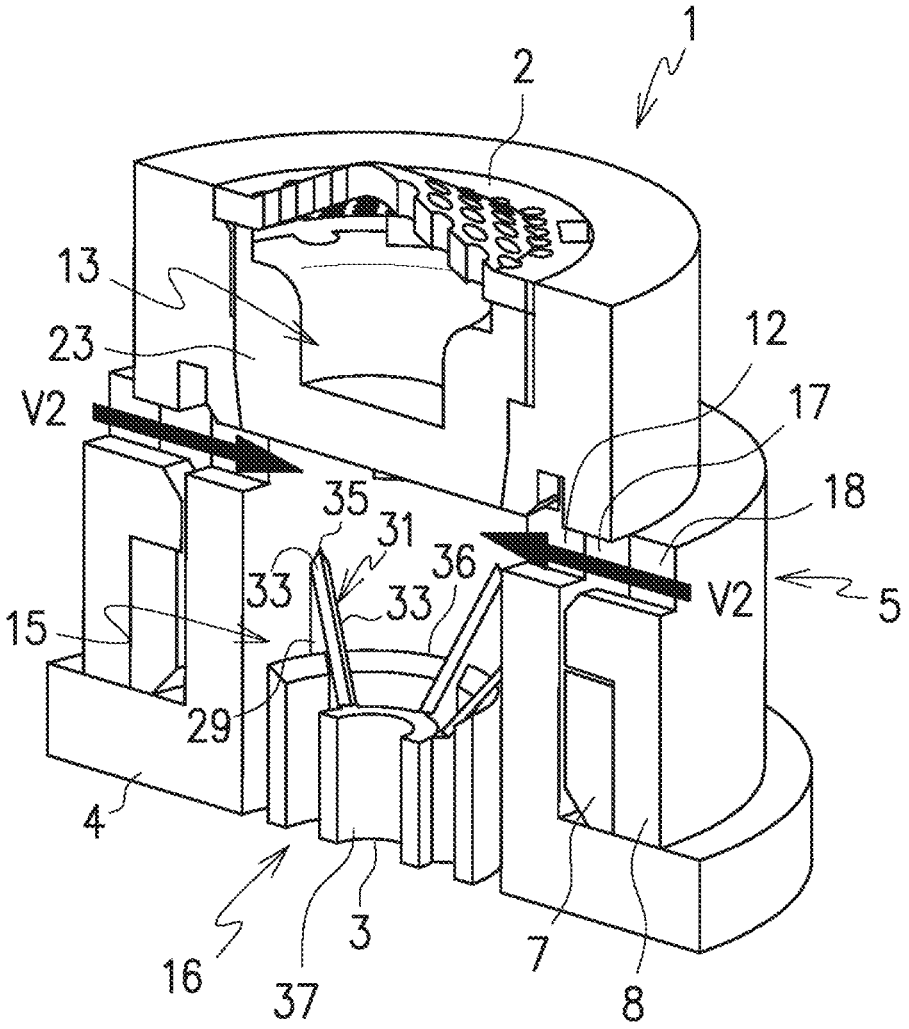

[Fig. 7]
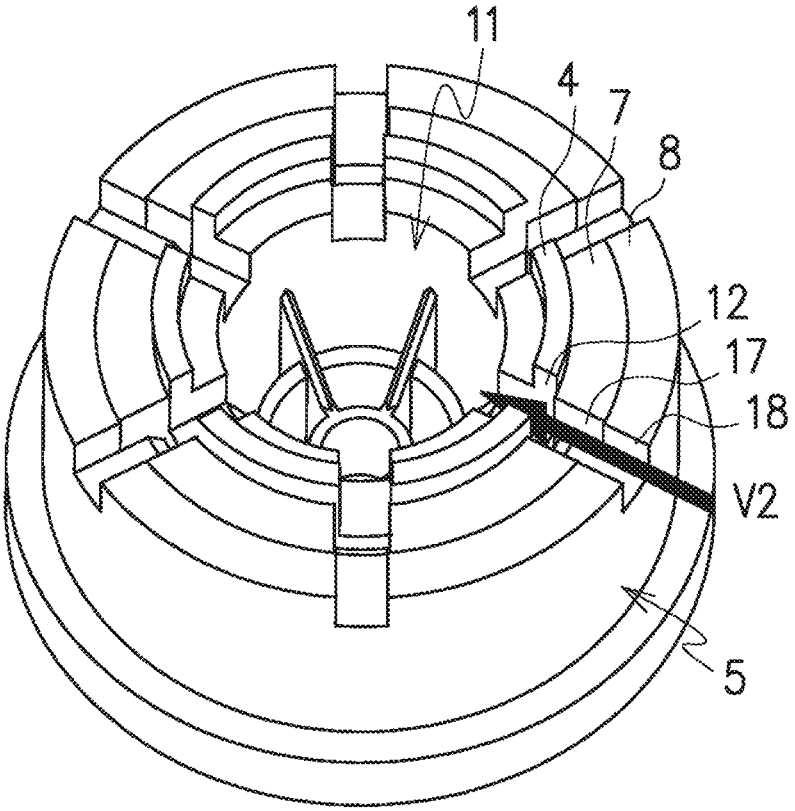

[Fig. 8]
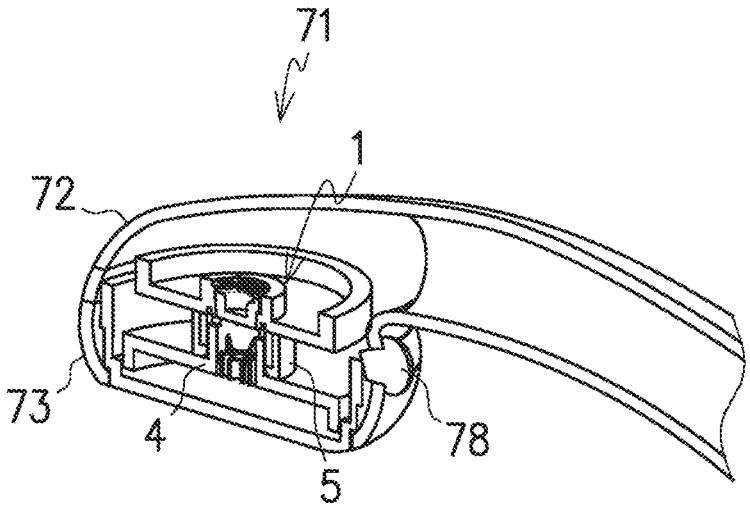

[Fig. 9]
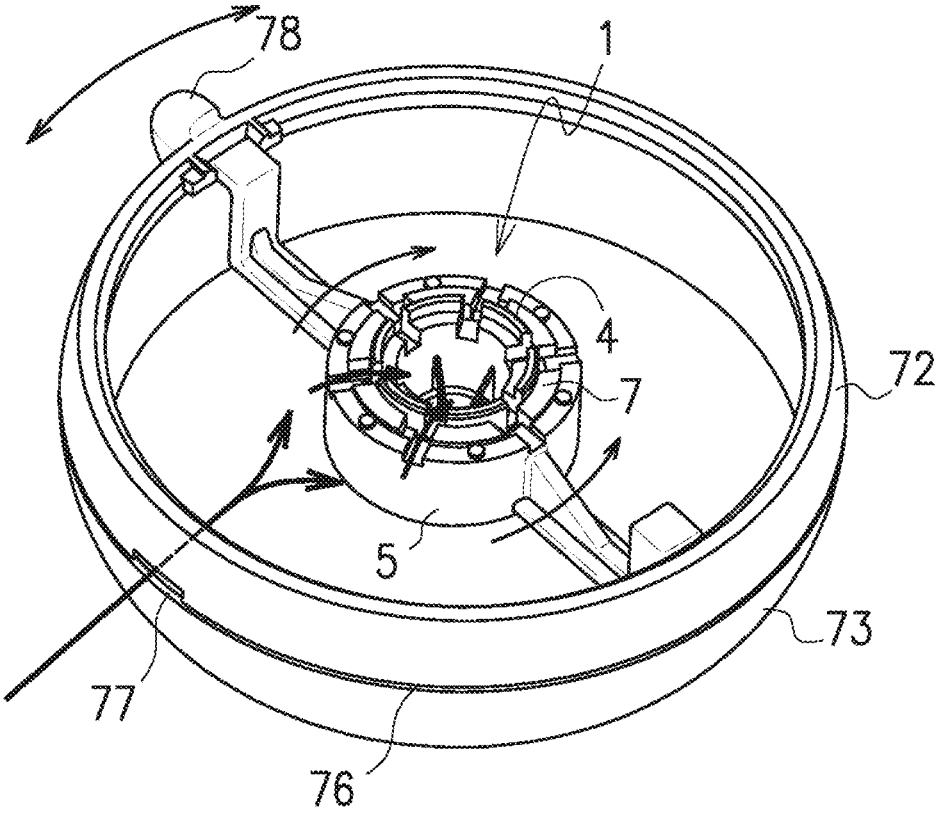

MICRO-BUBBLE GENERATOR AND SHOWER HEAD

TECHNICAL FIELD

The present invention relates to a micro-bubble generator and a shower head that generate fine air bubbles.

BACKGROUND ART

Conventional methods of generating micro-bubbles include: an extrusion method of extruding air through a porous filter under pressure; a cutting method of cutting running air using a fan or a similar device; and an ejector method of extruding air utilizing water viscosity.

With regard to the ejector method, there is disclosed a micro-bubble generator that includes: an inlet for pressurized liquid and gas; and a hollow cylindrical air bubble generation space (patent document 1). In the micro-bubble generator, the inlet for pressurized liquid and gas has pressurized-liquid inlet holes and gas inlet holes that are connected to the air bubble generation space. Also in the micro-bubble generators, the pressurized-liquid inlet holes are openings on the end surfaces of the inlet, and the gas inlet holes are connected to an opening disposed on a side surface of the inlet. Through the opening, a gas inlet tube connected to the gas inlet holes are disposed. The gas inlet tube is provided with an adjustment valve through which the amount of inflowing gas is adjusted.

The micro-bubble generator increases cleaning capability when the micro-bubble generator is incorporated in a water discharge device such as a running water faucet and/or a shower head. The water discharge device mixes air with part of inflowing water to turn part of outgoing water into air bubbles that are not as fine as micro-level bubbles. Also, the water discharge device makes foamed water by causing a water collision to occur in the water passage extending to the water outlet.

Such foamed water is generated by a device that includes a decompressor, a water passage, and a rectifier. The decompressor has a plurality of small holes between the water inlet and the water outlet. Through the small holes, water flowing from the water inlet is depressurized. The water passage has a plurality of air holes for containing air into the water allowing through the decompressor. The rectifier is disposed on the downstream side of the water passage, and causes the air-containing water to fall along the water passage, thereby adjusting the discharge direction toward the water outlet.

Patent document 2 discloses a water discharge device capable of selectively switching between three kinds of discharge firms, namely, rectification discharge, foamed water discharge, and shower discharge. The water discharge device includes a first cylinder and a second cylinder. In the first cylinder, a water passage is formed with a partition wall. The second cylinder is disposed with a ring-shaped gap between the second cylinder and the outer circumference surface of the first cylinder. The ring-shaped gap is connected to smaller diameter holes that are open toward the water outlet side. The water discharge device switches between: supply of rectification discharge by covering the ring-shaped gap; supply of shower discharge by opening the ring-shaped gap; and supply of foamed water discharge by introducing external air into the water passage through the smaller diameter holes and the ring-shaped gap.

RELATED ART DOCUMENTS

Patent Documents

[Patent document 1] JP 4002439B
[Patent document 2] JP 2005-290686A

SUMMARY

Problems to be Solved by the Invention

Micro-bubble generators employing the above-described conventional extrusion method and cutting method need to be equipped with motive power sources to pressurize air and rotate a fan at high speed. Also, there has been such a problem that accuracy is required of the machining of holes for generating micro-bubbles.

The conventional ejector method has difficulty as well in machining the air inlet hole and the gap accurately and uniformly on the micrometer level, causing varied amounts of inflowing air. This has caused mixture of larger air bubbles and/or occurrence of smaller amounts of air bubbles, resulting in such a problem that effective levels of washability can not be obtained. Also, filters and similar devices having a large number of fine holes have such a drawback that they are likely to clog up.

As disclosed in patent document 2, the amount of contaminating air is adjusted by a device that introduces external air into the water passage through the ring-shaped gap from the smaller diameter holes open toward the water outlet side, thereby switching between the rectification discharge and the shower discharge. This device, however, is not capable of generating air bubbles as fine as micro-bubbles.

Under the circumstances, one object of the present invention is to provide a micro-bubble generator that generates, without the need for a motive power source and a high level of machining accuracy, micro-bubbles containing a large amount of fine air bubbles. Another object of the present invention is to provide a micro-bubble generator that switches between micro-bubble water, which contains micro-bubbles, and foamed water containing a large amount of air and having a tender texture.

Means of Solving the Problems

In order to solve the above-described problem, the present invention provides a micro-bubble generator that includes: a water passage that includes a smaller diameter portion and a larger diameter portion disposed on a downstream side of the smaller diameter portion; an air inlet disposed in the larger diameter portion; and an elastic body disposed in the air inlet and is configured to isolate the water passage from external air. The elastic body is compressible by negative pressure generated in the water passage, causing the external air to be sucked into the water passage through the air inlet and over the compressed elastic body.

In the micro-bubble generator according to the present invention, it is proposed that the negative pressure is generated in the larger diameter portion by high-speed water flowing in the smaller diameter portion of the water passage.

In the micro-bubble generator according to the present invention, it is proposed that the elastic body is disposed on a wall surface of the air inlet such that—the elastic body is in pressure contact with the wall surface. When the elastic body is compressed by the negative pressure, a gap is generated between the elastic body and the wall surface, causing the external air to be sucked into the water passage through the gap in the air inlet.

In the micro-bubble generator according to the present invention, it is proposed that the elastic body is in pressure contact with the wall surface of the air inlet at a predetermined compression ratio, and that the elastic body is compressible in a direction orthogonal to the wall surface of the air inlet.

In the micro-bubble generator according to the present invention, the air inlet includes: a first air inlet in which the elastic body is disposed; and a second air inlet having an opening connected to the water passage. The air inlet is switchable between the first air inlet and the second air inlet.

One embodiment of the micro-bubble generator according to the present invention includes an inner case and an outer case. The inner case includes a water inlet hole, a water discharging hole, and an inner ventilation window disposed along a water passage disposed between the water inlet hole and the water discharging hole. The outer case is disposed on an outer side of the inner case and includes an outer ventilation window connected to the inner ventilation window. The outer case is configured to make a sliding movement with an outer circumference surface of the inner case, and includes an elastic body disposed inner side of the outer case. The elastic body is in pressure contact with the outer circumference surface of the inner case and is configured to make a sliding movement along the outer circumference surface of the inner case. The outer case is configured to press the inner case via the elastic body. When the outer case makes the sliding movement, a first air inlet and a second air inlet are switched to and from each other. The first air inlet is formed when the inner ventilation window and the outer ventilation window are displaced from each other, generating a gap between the outer circumference surface of the inner case and the elastic body and connecting the water passage to external air through the gap. The second air inlet is formed when a window position of the outer ventilation window is aligned with a window position of the inner ventilation window, connecting the water passage to the external air.

In a shower head according to the present invention, it is proposed that the shower head includes: the micro-bubble generator; a head case having a water inlet hole, a water discharging hole, and a water passage in which the micro-bubble generator is disposed; and a switching lever configured to switch between a first air inlet in which an elastic body is disposed and a second air inlet having an opening connected to the water passage.

Effects of the Invention

In the micro-bubble generator according to the present invention, external air is sucked into the water passage from the air inlet through the elastic body compressed by negative pressure generated in the water passage. This ensures that micro-bubbles containing a large amount of fine air bubbles are generated in the water passage. The micro-bubbles are charged with negative potential, enabling the micro-bubbles to perform such an operation as to attach to an object and remove a dirt off the object. Thus, the micro-bubbles have strong cleaning power. Also, the micro-bubbles increase the amount of dissolved oxygen in plants and other organisms, making them more bioactive, and increase the subcutaneous blood flow rate in human bodies, thus providing a blood flow acceleration effect.

Also in the micro-bubble generator according to the present invention, the negative pressure is generated in the larger diameter portion by high-speed water flowing in the smaller diameter portion of the water passage. The negative pressure is used to compress the elastic body, causing a gap to be generated in the air inlet and causing external air to be sucked into the water passage through the gap.

Also in the micro-bubble generator according to the present invention, the elastic body is disposed on a wall surface of the air inlet such that the elastic body is in pressure contact with the wall surface, and compressed by the negative pressure. This ensures that a gap small enough to allow a leakage is generated between the elastic body and the wall surface. The small gap is such a small gap that can not be obtained by machining such as boring. The gap is generated by negative pressure and is less likely to face with a problem such as clogging.

Also in the micro-bubble generator according to the present invention, a first air inlet and a second air inlet are provided. In the first air inlet, the elastic body is disposed. The second air inlet has an opening connected to a foamed water generator disposed in the water passage. This ensures that micro-bubble water and foamed water are switchably discharged. As described above, the micro-bubble water provides an effect of increasing cleaning capability. Also, since foamed water can contain a large amount of air, the particles that are discharged are large in diameter and come into contact with a larger area of human skin, providing a comfortable shower with a feeling of taking an abundant amount of water. Also, extruding inflowing air provides such an effect that the water increases in volume and flowing speed, resulting in improved discharge force.

The shower head according to the present invention ensures that micro-bubble water and foamed water can be switched to and from each other in a single shower head using an operation lever. Specifically, micro-bubble water and foamed water can be used for different purposes depending on a user's preferences. For example, micro-bubble water can be used mainly for removing a dirt from head or face skin, while foamed water can be used when there is a need for a force strong enough to wash away conditioner, body soap, or other toiletries, or when there is a need for a feeling of abundance.

BRIEF DESCRIPTION OF THE DRAWINGS

FIG. 1 illustrates a principle of a micro-bubble generator according to the present invention.

FIG. 2 is a vertical perspective, cross-sectional view of the micro-bubble generator.

FIG. 3 is a lateral perspective, cross-sectional view of the micro-bubble generator.

FIG. 4 is a perspective view of a bush constituting a decompressor.

FIG. 5 is a longitudinal sectional view of the micro-bubble generator.

FIG. 6 is a vertical perspective, cross-sectional view of the micro-bubble generator according to the present invention switched in foamed water mode.

FIG. 7 is a lateral perspective, cross-sectional view of the micro-bubble generator in the foamed water mode.

FIG. 8 is a cross-sectional view of a shower head with the micro-bubble generator incorporated in the shower head.

FIG. 9 is a perspective view of the shower head illustrating its internal structure with the micro-bubble generator incorporated in the shower head.

MODES FOR CARRYING OUT THE INVENTION

An embodiment of the micro-bubble (MB) generator according to the present invention will be described in detail below by referring to the accompanying drawings. First, a principle of the MB generator according to the present invention will be described below by referring to FIG. 1. As used herein, the term MB is intended to mean a fine air bubble having an air bubble diameter of equal to or less than 50 μm (0.05 mm), and the term MB water is intended to mean water containing such fine air bubbles. FIG. 1 illustrates the MB generator simplified for principle describing purposes. In the MB generator, a water passage 11 is defined by an upper case 6*a* and a lower case 6*b* that are closed by an elastic body 7. The water passage 11 includes: a smaller diameter portion R1, which has a smaller cross-section to increase the flowing speed of water inflowing through the water inlet 2; and a larger diameter portion R2, which is disposed on the downstream side of the smaller diameter portion R1 and which has a cross-section larger than the cross-section of the smaller diameter portion R1 to lower the flowing speed of the water flowing from the smaller diameter portion R1 toward the water outlet 3. An air inlet V is disposed in the larger diameter portion R2 at a position between the upper case 6*a* and the lower case 6*b*. In the air inlet V, the elastic body 7 is disposed to isolate the water passage 11 from external air. The elastic body 7 is in pressure contact with the upper case 6*a* and the lower case 6*b*. The pressure contact position of the elastic body 7 serves as an air inlet V0.

In the MB generator, the water inflowing through the water inlet 2 passes through the smaller diameter portion R1 at high flowing speed and reaches the larger diameter portion R2. This causes an ejector effect to occur, that is, there occures an operation of sucking air into the water passage 11 through the air inlet V0. As illustrated in FIG. 1(*b*), the air inlet V is such that the elastic body 7 fitted in a depression groove 6*c* of the lower case 6*b* is in pressure contact with the upper case 6*a*, thereby forming a closed state to block external air. As illustrated in FIG. 1(*c*), when the inflowing water passes through the smaller diameter portion R1 and reaches the larger diameter portion R2, an ejector effect occurs to cause a suction force on the water, and the suction force causes negative pressure in a region 11*a* in the water passage 11 near the air inlet V. The negative pressure causes the elastic body 7 to be compressed, generating a gap G, which is as small as equal to or less than approximately 0.05 mm, between the elastic body 7 and the upper case 6*a*. Through the small gap G generated in the air inlet V0, external air is sucked into the water passage 11, generating fine air bubbles each having a diameter of equal to or less than 0.05 mm. The gap G is formed when the elastic body 7 is compressed to a degree that permits air to leak in the air inlet V. For this purpose, the elastic body 7 is preferably in pressure contact with the upper case 6*a* at a predetermined compression ratio. For example, the compression ratio is set at approximately 8%.

FIGS. 2 to 7 illustrate an embodiment of the MB generator implemented based on the principle illustrated in FIG. 1. An MB generator 1 according to this embodiment has a function of generating MB and a function of generating foamed water containing larger air bubbles, and is capable of switching between the functions. The MB generator 1 includes: the water inlet 2 on the upper surface of the MB generator 1; the water outlet 3 on the lower surface of the MB generator 1; and the water passage 11 between the water inlet 2 and the water outlet 3. The MB generator 1 also includes: a cylindrical inner case 4, which has an inner ventilation window 12, which is open on the water passage 11; and a cylindrical outer case 5, which surrounds the inner case 4 and has an outer ventilation window 18, which is connected to the inner ventilation window 12.

In the inner case 4, the water passage 11 has an inner circumference surface that gradually diminishes in diameter from the water inlet 2 toward the water outlet 3. The water passage 11 includes: a decompressor 13, which decompresses the water flowing into the water inlet 2 from a water feeding source from the upstream side toward the downstream side so as to narrow down the water flow, thereby increasing the flowing speed of the water; a foam generator 14, which contains air in the water past the decompressor 13, thereby generating air bubbles; a foamed water generator 15, which converts the water past the foam generator 14 into finely foamed water; and a rectifier 16, which rectifies the foamed water past the foamed water generator 15 toward the water outlet 3.

The outer case 5 includes: a cylindrical outer wall portion 8; and the elastic body 7, which is disposed along the inner circumference surface of the outer wall portion 8 and which is in pressure contact with the outer circumference surface of the inner case 4. The elastic body 7 is in pressure contact with the outer circumference surface of the inner case 4 at a predetermined compression ratio. Also, when negative pressure is generated in the water passage 11, the elastic body 7 is compressed to a degree that permits air to leak between the elastic body 7 and the outer circumference surface of the inner case 4. The predetermined compression ratio of the elastic body 7 is preferably about 8%. Also, the elastic body 7 may be made of silicon rubber. As illustrated in FIG. 3, the elastic body 7 includes a plurality of intermediate ventilation windows 17 on the circumference of the elastic body 7. The intermediate ventilation windows 17 are connected to the respective outer ventilation windows 18. The elastic body 7, integrally with the outer case 5, is in pressure contact with the outer circumference surface of the inner case 4.

As illustrated in FIG. 2, the decompressor 13 includes a resin bush 23, which is press-fittable in the water inlet 2. As illustrated in FIG. 4, the bush 23 includes: a larger diameter portion 21, which has approximately the same diameter as the diameter of the water inlet 2; and a smaller diameter portion 22, which is adapted to the inner circumference surface of the water passage 11 and which is smaller in diameter than the larger diameter portion 21. The decompressor 13 includes vertical stripe-shaped grooves 25, which are formed along the shape of the outer circumference surface of the bush 23, that is, extend between an upper surface 21*a* of the larger diameter portion 21 and a lower surface 22*a* of the smaller diameter portion 22. The vertical stripe-shaped grooves 25 are provided in plural at equal intervals in the circumferential direction of the bush.

Each of the grooves 25 includes: a perpendicular portion 25*a*, which has an approximately perpendicular surface parallel to the outer circumference surface of the larger diameter portion 21 of the bush 23; a bent portion 25*b*, which is bent slightly from the lower end of the perpendicular portion 25*a* toward an upper part of the smaller diameter portion 22; and an inclined portion 25*c*, which is inclined and extends from the lower end of the bent portion 25*b* toward the lower surface 22*a* of the smaller diameter portion 22.

The bush 23 is fitted in the inner case 4 such that the bush 23 is in close contact with the water inlet 2. With the bush 23 fitted in the inner case 4, a plurality of water guiding passages 24, which respectively correspond to the plurality of grooves 25, are formed between the outer circumference surface of the bush 23 and an inner circumference surface of the inner case 4. Each of the water guiding passages 24 corresponds to the smaller diameter portion R1 illustrated in FIG. 1, and diminishes in diameter between the perpendicular portion 25*a* and the bent portion 25*b*. This ensures that the water flowing in the water guiding passage 24 increases in flowing speed while running downward along the inclined portion 25*c*, gushing toward the downstream side of the water passage 11. On the downstream side of the water guiding passages 24, there are provided the foam generator 14, which turns the water past the water guiding passage 24 into air bubbles; and the foamed water generator 15, which generates foamed water. The foam generator 14 and the foamed water generator 15 correspond to the larger diameter portion R2 illustrated in FIG. 1, and are larger in cross-sectional area than the water guiding passage 24. While in this embodiment the water guiding passages 24 are set at six positions, the water guiding passages 24 will not be limited to six positions; the water guiding passages 24 may be set at any other number of positions as desired according to the inner diameter of the water passage 11, the pressure of the water supplied, and/or other conditions.

As illustrated in FIGS. 5 and 6, the foamed water generator 15 includes flow dividing ribs 31. When the water guided by the water guiding passages 24 is mixed with air introduced through the inner ventilation window 12 of the inner case 4, the flow dividing ribs 31 divide the flow of the water mixture in multiple directions. Each of the flow dividing ribs 31 has an inclined leading end portion.

The flow dividing rib 31 is formed of a protrusion piece 29. The protrusion piece 29 has an approximately triangular plane shape protruding from the inner circumference surface of the water passage 11. The flow dividing rib 31 is inclined downward from the inner circumference surface of the water passage 11 toward a center portion of the water passage 11. The flow dividing rib 31 includes: an edge 35, which is the center in the longitudinal direction of the flow dividing rib 31; and a pair of inclined surfaces 33, which are disposed on the right and left sides of the edge 35 and are inclined at a predetermined angle. The inclination angle of the pair of inclined surfaces 33, which are disposed on the right and left sides of the edge 35, is set based on the speed of the flow to be discharged. When the inclination angle of the inclined surface 33 is set at an acute angle, the flow of water can be divided without decreasing the flowing speed of the water. When the inclination angle of the inclined surface 33 is set at an obtuse angle, the flow of water can be divided with the flowing speed of the water lowered. While in the embodiment illustrated in FIG. 6 the inclined surfaces 33 of the flow dividing rib 31 are provided in pairs, it is also possible that each inclined surface 33 may have a plurality of inclinations having different inclination angles.

It is to be noted that the flow dividing ribs 31 are for the purposes of dispersing a water flow in multiple directions and causing a water collision to occur, thereby converting water into foamed water. While the flow dividing rib 31 divides a water flow uniformly in directions parallel to the pair of inclined surfaces 33, the dividing of a water flow encompasses a dividing in the front and rear directions.

The water flowing through the plurality of flow dividing ribs 31 is approximately 30 percent to 40 percent of the water flowing through the water passage 11 as a whole, but flows in varying directions as opposed to water directly reaching a circular rib 36 past the foam generator 14. Also, by passing through elements including the flow dividing ribs 31 and the circular rib 36, the water flowing through the plurality of flow dividing ribs 31 undergoes more water collisions in the water passage 11.

The rectifier 16 includes: the circular rib 36, which connects downstream side portions of the flow dividing ribs 31 in a ring form, and a plurality of vertical ribs 37, which extend toward the water outlet 3 from the circular rib 36.

As illustrated in FIG. 5, the inner ventilation window 12 is disposed at a position displaced from positions immediately above the flow dividing ribs 31. Specifically, the inner ventilation window 12 is disposed at a position displaced from the passages of water flowing from the water guiding passages 24, which are disposed in the decompressor 13, toward the flow dividing ribs 31. Thus, the inner ventilation window 12 is set at a position displaced in the right and left directions from a linear passage connecting the water guiding passage 24 and the edge 35 of the flow dividing rib 31. This makes a leakage of water through the inner ventilation window 12 less likely to occur when there is a pressure loss source, such as a filter and a shower watering plate, on the downstream side of the water outlet 3.

As illustrated in FIGS. 2 and 3, in the micro-bubble generator according to the present invention, when the outer case 5 makes a sliding movement in a predetermined direction along the outer circumference surface of the inner case 4, the inner ventilation window 12, the intermediate ventilation window 17, and the outer ventilation window 18 are displaced from each other, forming a first air inlet V1 between the outer circumference surface of the inner case 4 and the elastic body 7. Through the first air inlet V1, the water passage 11 is connected to the outside. As illustrated in FIGS. 6 and 7, in the micro-bubble generator according to the present invention, when the window positions of the intermediate ventilation window 17 and the outer ventilation window 18 are aligned with the window position of the inner ventilation window 12, a second air inlet V2 is formed. Through the second air inlet V2, the water passage 11 is connected to the outside. The second air inlet V2 and the first air inlet V1 are switchable to and from each other. The positions defining the first air inlet V1 will be hereinafter referred to as MB mode, and the positions defining the second air inlet V2 will be hereinafter referred to as foamed water mode.

As illustrated in FIGS. 1 to 5, in the MB mode, the inner ventilation window 12 is covered by the pressure contact with the elastic body 7. This greatly reduces the amount of inflowing air introduced into the water passage 11 through the outer ventilation window 18 and the intermediate ventilation window 17. In this respect, although the elastic body 7 is in pressure contact with the outer circumference surface of the inner case 4, the compression ratio of the elastic body 7 is set at a value as low as about 8%, as described above. This ensures that when negative pressure is generated in the foam generator 14 by high-speed water flowing in the water guiding passage 24, the negative pressure causes the elastic body 7 to be compressed, generating a small gap of a size that permits air to leak between the elastic body 7 and the outer circumference surface of the inner case 4. The width of the gap G may be set at a maximum of equal to or less than approximately 0.05 mm. This ensures that the inner ventilation window 12, the intermediate ventilation window 17, and the outer ventilation window 18 are connected to each other through the gap G, causing external air to be sucked to generate fine air bubbles each having a diameter of equal to or less than 0.05 mm in the foam generator 14. In the foam generator 14 and the foamed water generator 15, the fine air bubbles are mixed with the water past the water ling passages 24 and are discharged as MB water containing micro-level air bubbles. Each of the air bubbles contained in MB is equal to or less than approximately 1/20 of the size of each air bubble in the foamed water mode.

FIGS. 6 and 7 illustrate a state switched into the foamed water mode. In the foamed water mode, the inner ventilation window 12 of the inner case 4 and the outer ventilation window 18 of the outer case 5 are connected to each other through the intermediate ventilation window 17. By this connection, the second air inlet V2 is formed between the inner case 4 and the outer case 5, ensuring that much more air is sucked into the water passage 11. This ensures that larger air bubbles are generated in the foam generator 14, and the larger air bubbles are mixed with the water past the water guiding passage 24 in the foam generator 14 and the foamed water generator 15, with the result that foamed water containing the larger air bubbles is discharged from the water outlet 3. Such foamed water comes into contact with a larger area of human skin, providing a comfortable shower with a feeling of taking an abundant amount of water. Also, such foamed water increases the force of water,ensuring that a water conservation effect is obtained.

FIGS. 8 and 9 illustrate an example in which the MB generator 1 according to the above-described embodiment is incorporated in a shower head 71. The shower head 71 includes: an upper case 72, which is connected to the water inlet of a water plug through a hose or a similar device; and a lower case 73, which has a plurality of discharge holes (not illustrated) for obtaining shower-form discharge water. An air hole 77 is disposed at the joint of the upper case 72 and the lower case 73.

As illustrated in FIG. 9, the MB generator 1 incorporated in the shower head 71 includes: the inner case 4, which is disposed at a center portion of the lower case 73; and the outer case 5, which is slidable along the outer circumference surface of the inner case 4. On the outer case 5, a switching lever 78 is disposed. The switching lever 78 protrudes from one end of an outer circumference portion of the outer case 5 toward the outside of the upper case 72 and the lower case 73. By sliding the switching lever 78 to the right or left, the MB mode illustrated in FIGS. 2 and 3 and the foamed water mode illustrated in FIGS. 6 and 7 are switchable to and from each other.

The air hole 77 is regulated by a gap defined by an O-ring 76, which seals the upper case 72 and the lower case 73. That is, by adjusting the degree by which the upper case 72 and the lower case 73 are tightened, the opening width of the air hole 77 can be finely adjusted in a desired manner The air hole 77 is for supplying external air to the MB generator 1 built in the shower head 71; in particular, the air hole 77 is capable of adjusting the size of air bubbles in the state switched into the foamed water mode. In the MIB mode, however, the generation of MB is greatly affected by the gap G, which is generated by the compression of the elastic body 7, which is closest to the inner ventilation window 12. Therefore, the opening width of the air hole 77 does not directly affect the generation of MB.

MB generated by the MB generator having the above-described configuration is charged with negative potential, enabling the MB to perform such an operation as to attach to an object and remove a dirt off the object. Thus, the MB has strong cleaning power. As such, the MB increases the amount of dissolved oxygen in plants and other organisms, making them more bioactive. Also, the MB increases the subcutaneous blood flow rate in human bodies, thus providing a blood flow acceleration effect. This provides such an effect that the temperature of the water is felt like a higher temperature, resulting in an increase in deep body temperature. In contrast, foamed water generated with larger air bubbles contained provides a comfortable shower with a feeling of taking an abundant amount of water, even if the amount of the foamed water is small. Thus, such foamed water excels in water conservation property.

DESCRIPTION OF REFERENCE NUMERALS

MB Micro-bubble
R1 Smaller diameter portion
R2 Larger diameter portion
G Gap
V Air inlet
V0 Air inlet
V1 First air inlet
V2 Second air inlet
1 MB generator
2 Water inlet hole
3 Water discharging hole
4 Inner case
5 Outer case
6*a* Upper case
6*b* Lower case
6*c* Depression groove
7 Elastic body
8 Outer wall portion
11 Water passage
11*a* Region of water passage near air inlet
12 Inner ventilation window
13 Decompressor
14 Foam generator
15 Foamed water generator
16 Rectifier
17 Intermediate ventilation window
18 Outer ventilation window
21 Larger diameter portion
21*a* Upper surface
22 Smaller diameter portion
22*a* Lower surface
23 Bush
24 Water guiding passage
25 Groove
25*a* Perpendicular portion
25*b* Bent portion
25*c* Inclined portion
29 Protrusion piece
31 Flow dividing rib
33 Inclined surface
35 Edge (ridge)
36 Circular rib
37 Vertical rib
71 Shower head
72 Upper case
73 Lower case
76 O-ring
77 Air hole
78 Switching lever

What is claimed is:

1. A micro-bubble generator comprising:

a water passage comprising:

a smaller diameter portion; and a larger diameter portion disposed on a downstream side of the smaller diameter portion;

an air inlet disposed in the larger diameter portion; and an elastic body disposed in the air inlet and configured to isolate the water passage from external air, wherein the elastic body is disposed on a wall surface of the air inlet such that the elastic body is in pressure contact with the wall surface, and wherein the elastic body is compressible by negative pressure generated in the water passage generating a gap between the elastic body and the wall surface and causing the external air to be sucked into the water passage through the gap in the air inlet.

2. The micro-bubble generator according to claim 1, wherein the negative pressure is generated in the larger diameter portion by high-speed water flowing in the smaller diameter portion of the water passage.

3. The micro-bubble generator according to claim 1, wherein the elastic body is in pressure contact with the wall surface of the air inlet at a predetermined compression ratio.

4. The micro-bubble generator according to claim 1, wherein the elastic body is compressible in a direction orthogonal to the wall surface of the air inlet.

5. The micro-bubble generator according to claim 1, wherein the smaller diameter portion comprises a plurality of smaller diameter portions disposed in the water passage.

6. The micro-bubble generator according to claim 1, wherein the air inlet comprises a first air inlet in which the elastic body is disposed, and a second air inlet having an opening connected to the water passage, and wherein the air inlet is switchable between the first air inlet and the second air inlet.

7. A micro-bubble generator comprising:

an inner case comprising:

a water inlet hole;

a water discharging hole; and an inner ventilation window disposed along a water passage disposed between the water inlet hole and the water discharging hole; and an outer case disposed on an outer side of the inner case and comprising an outer ventilation window connected to the inner ventilation window, wherein the outer case is configured to make a sliding movement with an outer circumference surface of the inner case, and comprises an elastic body disposed in the outer case, the elastic body being in pressure contact with the outer circumference surface of the inner case and configured to make a sliding movement along the outer circumference surface of the inner case, wherein when the outer case makes the sliding movement, a first air inlet and a second air inlet are switched to and from each other, wherein the first air inlet is formed when the inner ventilation window and the outer ventilation window are displaced from each other, generating a gap between the outer circumference surface of the inner case and the elastic body and connecting the water passage to external air through the gap, and wherein the second air inlet is formed when the outer ventilation window is aligned with the inner ventilation window, connecting the water passage to the external air.

8. A shower head comprising:

the micro-bubble generator according to claim 7;

a head case having a water inlet hole, a water discharging hole, and a water passage in which the micro-bubble generator is disposed; and a switching lever configured to switch between the first air inlet in which the elastic body is disposed and the second air inlet having an opening connected to the water passage of the micro-bubble generator.

9. The shower head according to claim 8, wherein the head case has an external air inlet disposed at least at one position in the head case, and wherein external air is guided into the first air inlet or the second air inlet through the external air inlet.

* * * * *